US008157464B2

(12) United States Patent
Prax

(10) Patent No.: US 8,157,464 B2
(45) Date of Patent: Apr. 17, 2012

(54) DISPOSABLE FLUID APPLICATOR

(76) Inventor: Ralf Prax, Willoughby Hills, OH (US)

( * ) Notice: Subject to any disclaimer, the term of this patent is extended or adjusted under 35 U.S.C. 154(b) by 178 days.

(21) Appl. No.: 12/796,611

(22) Filed: Jun. 8, 2010

(65) Prior Publication Data

US 2010/0239353 A1 Sep. 23, 2010

Related U.S. Application Data

(63) Continuation-in-part of application No. 12/237,461, filed on Sep. 25, 2008.

(51) Int. Cl.
*B43K 5/14* (2006.01)

(52) U.S. Cl. ..... 401/133; 401/132

(58) Field of Classification Search ..... 401/132, 401/133, 134
See application file for complete search history.

(56) References Cited

U.S. PATENT DOCUMENTS 2,044,428 A * 6/1936 Gilmer ..... 401/8
3,053,385 A * 9/1962 Spees ..... 206/361
3,369,267 A * 2/1968 Friedland et al. ..... 15/104.94
7,651,290 B2 * 1/2010 Bauer et al. ..... 401/133

* cited by examiner

*Primary Examiner* — Huyen Le
(74) *Attorney, Agent, or Firm* — Christopher J. Vandam, PA; Chris Vandam

(57) ABSTRACT

A disposable fluid applicator having a reservoir with a first membrane and a second membrane. Said reservoir containing a fluid to be dispensed. Said first membrane of the reservoir having perforations and being covered by a permeable and/or absorbent spreader. A removable tab assembly is disposed between said spreader and said first membrane of the reservoir that seals said reservoir. When the tab is pulled from between said spreader and said first membrane of the reservoir the reservoir becomes unsealed allowing the fluid contained inside the reservoir to flow out through an opening in the first membrane into and through the spreader where the fluid can be applied to a desired surface.

7 Claims, 5 Drawing Sheets

DISPOSABLE FLUID APPLICATOR

OTHER RELATED APPLICATIONS

The present application is a continuation-in-part of pending of U.S. patent application Ser. No. 12/237,461, filed on Sep. 25, 2008, as well pending PCT Application Serial No. PCT/US08/866,999 filed on Dec. 16, 2008, both of which are hereby incorporated by reference.

BACKGROUND OF THE INVENTION

1. Field of the Invention

The present invention relates to fluid applicators, and more particularly, to a disposable fluid applicator that contains fluid and selectively dispenses said fluid.

2. Description of the Related Art

Several designs for fluid applicators have been designed in the past. None of them, however, includes a fluid reservoir that may be easily and safely opened without applying pressure to a frangible seal combined with a spreader and in a disposable format.

Applicant believes that the closest reference corresponds to U.S. Pat. No. 6,547,468 issued to Gruenbacher et. al. However, it differs from the present invention because the Gruenbacher device employs a frangible seal to open a reservoir and requires pressure to rupture the seal before use. When a user applies pressure to rupture the frangible seal and thus open said reservoir the rupture tends to be uncontrollable and creates the likelihood that more of the contents of the reservoir are dispensed when applying pressure to break the seal than desired. Similarly, because the reservoir seal is frangible the device must be protected from pressure before the device is used or the risk of unintended rupturing of the frangible seal remains.

Kerch et. al. discloses in U.S. Pat. No. 4,762,124 a liquid dispensing pouch that does not include a reservoir to contain the liquid being dispensed and therefore is limited in the amount of liquid that can be dispensed by the device to how much liquid can be absorbed in the absorbent layer. Furthermore, the Kerch design will not likely allow all of the fluid contained in the absorbent layer to be fully dispensed because some of the fluid will remain in the absorbent layer thereby reducing its efficiency.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that efficiently and safely dispenses fluid in a controlled manner.

It is an object of the present invention to demonstrate a highly portable device to store fluid in a hermetically sealed container and then spread the fluid with finger pressure.

It is another object of this invention to provide a device that is environmentally responsible yet is disposable.

It is still another object of the present invention to provide a device that avoids overspray, is hygienic, provides even coverage of the dispensed fluid, is easy to transport and is durable for storage and transport.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

The present device is a disposable fluid applicator. The device is ideally suited for the application of fluids onto the human body, for example, lotion, cream, sunscreen, insect repellant, moisturizer, sanitizer, soap, beauty treatment, colorant or any other desirable foam, emulsion, gel, cream or fluid. The device is equally suited to dispense fluid for other applications, for example, polish, sanitizer, cleaner, cleanser, wood stain, automotive treatment or any other desirable gel, cream, chemical or other fluid.

Figure 1:
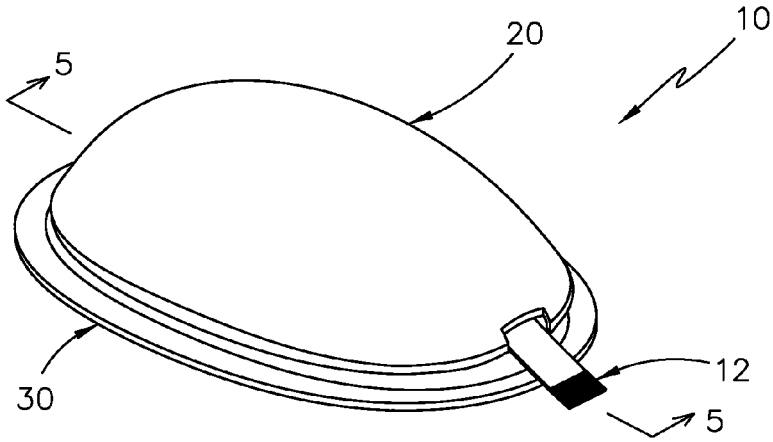
FIG. 1 represents a perspective view of an embodiment of the disposable fluid applicator.

Referring now to the drawings, where in FIG. 1 the present invention is generally referred to with numeral 10 (sometimes referred to as "the device"), it can be observed that it basically includes a tab assembly 12, a applicator assembly 20 and a reservoir assembly 30.

Figure 2:
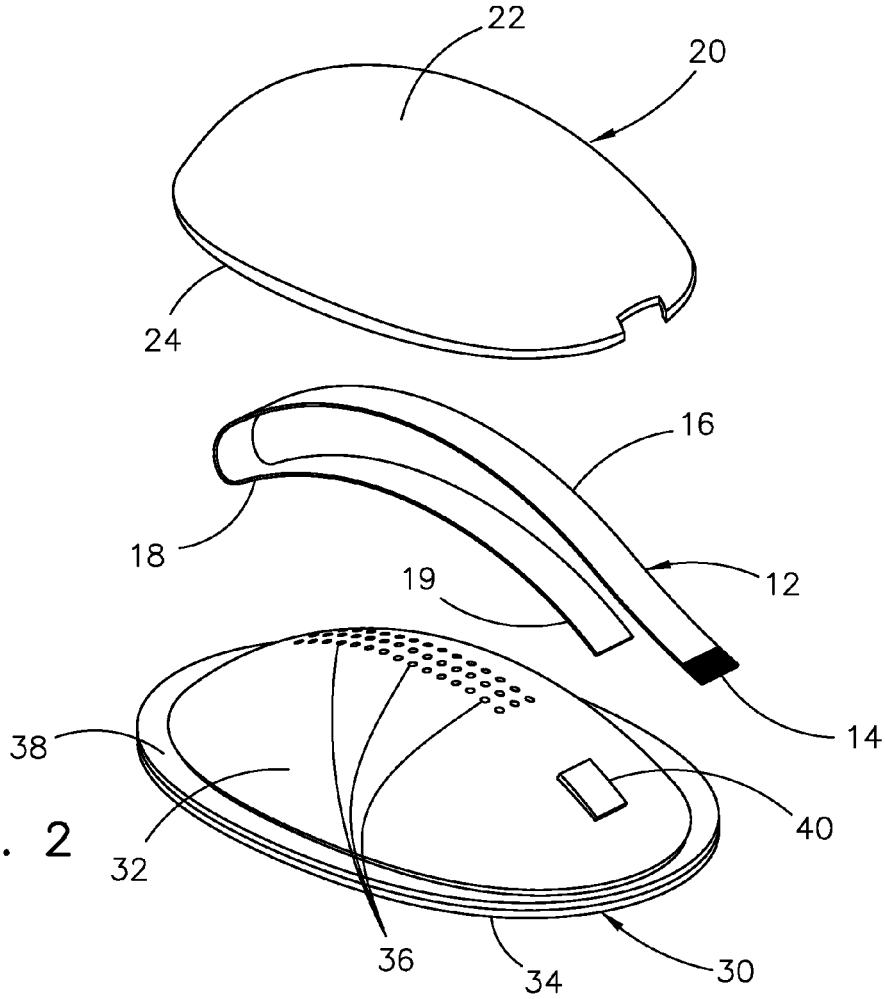
FIG. 2 shows an exploded perspective view of an embodiment of the disposable fluid applicator.

Now referring to FIG. 2 where an exploded view of the invention is shown. It can be seen that the tab assembly 12 is further comprised of a grip 14 and a tape 16. Said tape 16 having, inter alia, a surface 18 and a surface 19. Said applicator assembly 20 is shown to be comprised of, inter alia, a spreader 22 and an edge 24. said reservoir assembly 30 is shown to be comprised of, inter alia, a membrane 32, a membrane 34, perforations 36, a seam 38 and a seal 40.

In the embodiment shown in FIG. 2 said spreader 22 may be comprised of any of commonly used materials that is permeable by a fluid contained inside of the reservoir assembly. For many applications this could include a fibrous material, a porous synthetic or natural material, sponge, woven or knitted fabric, bristles or any other material known in the art to permit a fluid contained inside the reservoir assembly 30 to flow through the applicator assembly 20 so it can be spread on a surface with the applicator 22. For example, if the fluid to be dispensed is sunscreen a non-woven fibrous material would be one of several suitable choices of material for the spreader 22. In another example, if the fluid dispensed is to be a cleaning fluid, bristles may be one of several suitable selections for the spreader 22.

Still referring to FIG. 2, said reservoir assembly 30 is formed from said membrane 32 on a first side and said membrane 34 on a second side. Membrane 32 and membrane 34 are joined together around the periphery of membrane 32 and membrane 34 at said seam 38 to form a generally hollow interior reservoir that contains a fluid to be dispensed. Said seam 38 may be formed by means of welding, adhesive, stitching, crimping or any other means commonly known in the art to create a leak-resistant seal between membrane 32 and membrane 34.

In the embodiment demonstrated in FIG. 2 said membrane 32 and said membrane 34 are both formed of a flexible and impermeable material, such as a synthetic polymer, foil, natural material or any suitable flexible and impermeable material known in the art. In an alternate embodiment, the membrane 34 may be made of a rigid or semi-rigid impermeable material. In any embodiment it is preferred to have at least either of membrane 32 or membrane 34 constructed of a flexible material to aid in the dispensation of a fluid contained in the reservoir assembly 30 by applying squeezing pressure by a users hand onto membrane 32 and membrane 34.

Yet referring to FIG. 2, a multiplicity of perforations 36 are positioned on and penetrate through membrane 32. Said perforations 36 are the conduit by which a fluid contained inside the reservoir assembly 30 exits the reservoir assembly 30 and passes into the applicator assembly 20. The diameter of the perforations 36 are dimensioned to compliment the viscosity of fluid being dispensed by the device. For thicker fluids the perforations 36 are typically dimensioned larger than if a lower viscosity fluid was being dispensed by the device.

Similarly the quantity of perforations 36 may vary depending on the viscosity of the fluid dispensed as well as how quickly the fluid should be dispensed. For example, if the device is used for polishing furniture the reservoir assembly is filled with furniture polish with a relatively low viscosity and the invention is to be used on multiple pieces of furniture then the diameter of the perforations 36 and the quantity of the perforations 36 would both be reduced than if used with a higher viscosity fluid and/or a more rapid dispensation time period. Typically between one and one hundred perforations 36 that are between 0.5 mm and 25 mm are present on the membrane 32. As would be appreciated by a practitioner of normal skill in the art, the quantity and diameter of the perforations 36 may vary depending on, inter alia, the viscosity of the fluid dispensed and for which type of application the disposable fluid dispenser 10 is being used.

The disposable fluid dispenser 10 is in a storage mode when all present perforations 36 are covered and sealed by said tab assembly 12. Said surface 18 of the tab assembly 12, in one embodiment, is coated with a pressure sensitive adhesive that is permanently adhered to said surface 18 and is removably adhered to the surface of membrane 32 that faces said applicator assembly 20 effectively temporarily sealing all of said perforations 36. The position of said perforations 36 are complimentary to the dimensions of said surface 18 of the tab assembly 12 to ensure that surface 18 covers each of the perforations 36.

Figure 3:
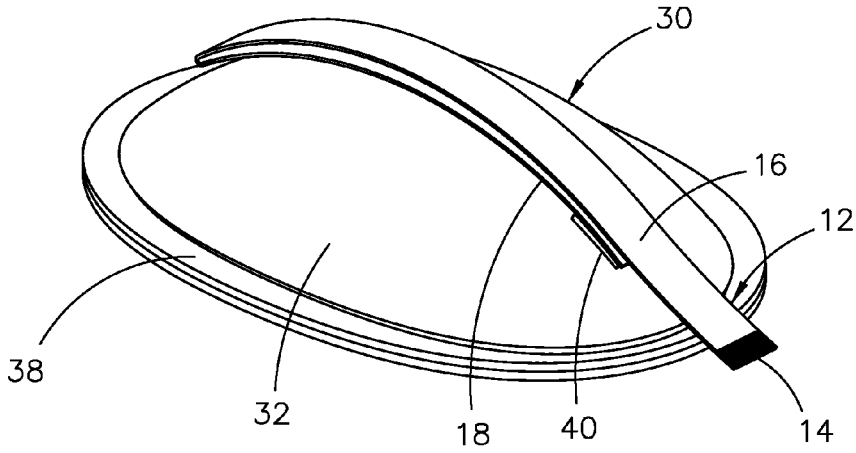
FIG. 3 illustrates a perspective view of an embodiment of the disposable fluid applicator without the applicator assembly where the tab assembly is not removed from the reservoir assembly.
Figure 4:
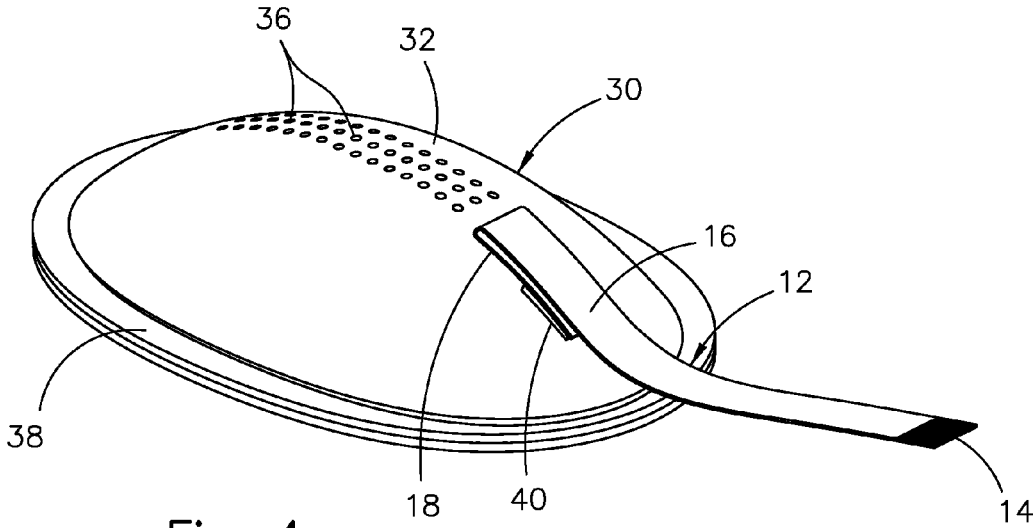
FIG. 4 is a representation of a perspective view of an embodiment of the disposable fluid applicator without the applicator assembly where the tab assembly is partially removed from the reservoir assembly.

Now referring in FIGS. 3 & 4 where for better understanding of the device 10 the applicator assembly 20 is not shown. For the embodiment shown in FIG. 1 the device 10 functions better for most applications to have the applicator assembly 20 permanently affixed to the membrane 32 around the periphery of the edge 24 of the applicator assembly 20 except where the tab assembly 12 protrudes from the seam between the applicator assembly 20 and the reservoir assembly 30. It is contemplated that for some uses of the device 10 that the applicator assembly 20 is not necessary for the functionality of the device.

Shown in FIG. 3 is the storage mode of the device 10 where the tab assembly 12 fully covers said perforations 36 with surface 18 removably adhered to membrane 32. FIG. 4 demonstrates the position of the tab assembly 12 partially removed from the membrane 32 thereby unsealing the perforations 36. When the tab assembly 20 is removed from the device 10 by a user and the perforations 36 are unsealed the fluid contained inside the reservoir assembly 30 is able to exit the reservoir assembly 30 through the perforations 36 and into the spreader 22 of the applicator assembly 20 where the fluid can be spread onto a desired surface. In at least one embodiment the spreader 22 is both porous and absorbent so that as the dispensed fluid is expelled the fluid is less likely to drip or otherwise deliver the fluid to an undesired surface due to the absorbent characteristics of the spreader 22.

Still referring to FIG. 4, seal 40 on a first side is permanently affixed to membrane 32. Seal 40 on its second side has an adhesive surface that is removably adhered to surface 18 of the tab assembly 12 when the device is in storage mode. When the grip 14 of the tab assembly 12 is pulled out and removed from between the applicator assembly 30 (not shown in FIG. 4) and the reservoir assembly 30 the second side of seal 40 is exposed to contact the applicator assembly 20 thereby completing the seal between the periphery of the applicator assembly 20 and the periphery of the reservoir assembly 32. Thus, as the device 10 is used and the fluid contained in the reservoir assembly 30 is expelled through the perforations 36 the fluid cannot escape through the gap between the applicator assembly 20 and the reservoir assembly 30 where the tab assembly 12 was after it is removed from the device 10. As disclosed above, the balance of the periphery of the spreader assembly 20 is permanently adhered to the reservoir assembly 30.

Figure 5:
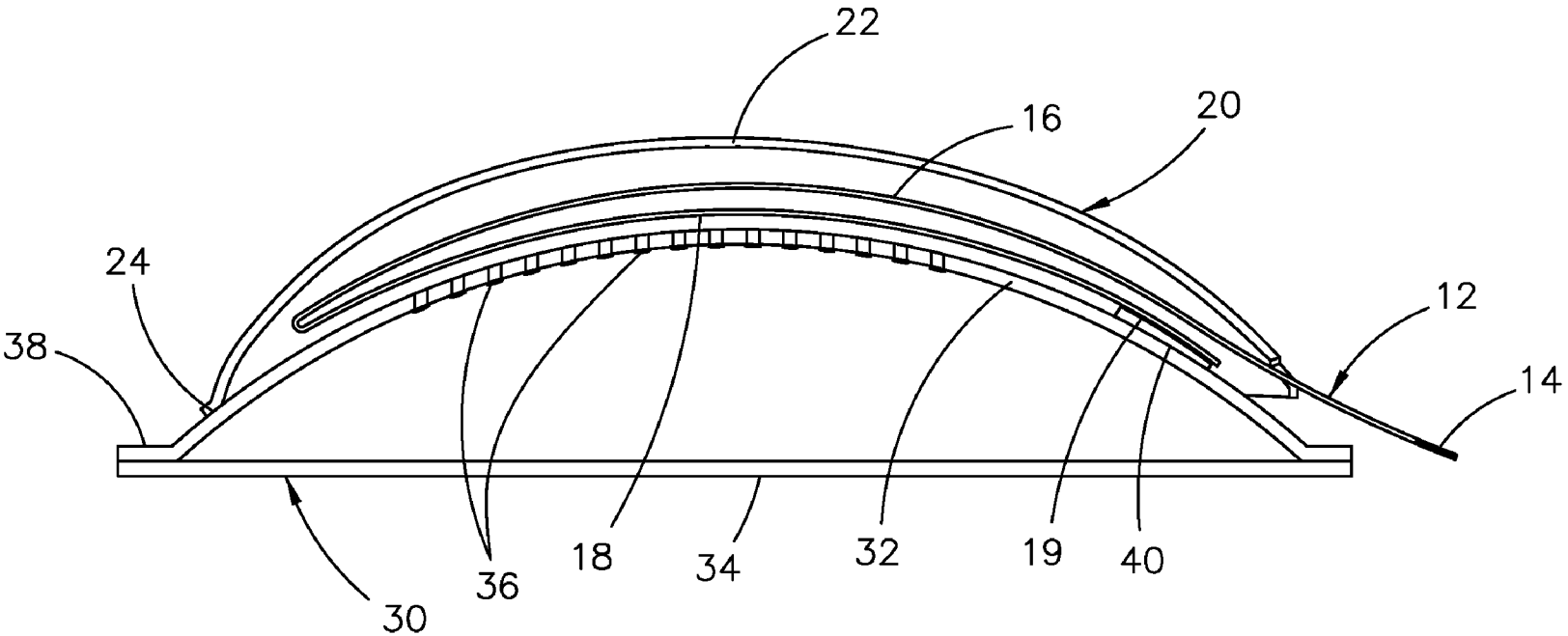
FIG. 5 is a cross section along cross section indicator lines shown in FIG. 1 demonstrating the various layers of the several assemblies comprising the device.

Referring now to FIG. 5 where a cross section elevation of FIG. 1 is shown. The tab assembly 12 is disposed between the applicator assembly and membrane 32 of the reservoir assembly 30. The fluid to be dispensed by the device 10 is contained between membrane 32 and membrane 34. When the tab assembly 12 is removed from between the applicator assembly 20 and the reservoir assembly 30 said fluid can exit the reservoir assembly 30 through the perforations 36 and flow into the spreader 22 of the applicator assembly 20 where the fluid can be applied to a target surface.

Also shown in FIG. 5 is seal 40 permanently affixed to membrane 32. A surface 19 on the tab assembly 12 is removably affixed to the seal 40. When the device 10 is prepared for use the tab assembly 12 is removed from between the applicator assembly 20 and the membrane 32 thus allowing the seal 19 to be in contact with and affix itself to the applicator assembly 20 and complete the connection between the applicator assembly 20 and the membrane 32 and allowing the only egress for the fluid contained inside the reservoir assembly 30 to be through the perforations 36 in the membrane 32.

In but one of several contemplated uses of the device 10 sunscreen lotion is fills the reservoir formed between membrane 32 and membrane 34. With the tab assembly in place as shown in FIG. 5 the device 10 is crush-resistant and leak-resistant and therefore can be stored and transported without special care. When a user of the device is desirous of applying the sunscreen lotion she pulls on grip 14 to remove the tab assembly 12 from between the applicator assembly 20 and reservoir assembly 30 and unseals the perforations 36. The user then squeezes the reservoir assembly with their fingers allowing the suntan lotion to flow through the perforations 36 in the membrane 32, into and through the spreader 22 where the fluid can be applied to the user's skin. It would be appreciated to one reasonably skilled in the art that the device 10 not be necessarily in a disk shape as demonstrated in FIG. 1. Alternatively the device could be rectangular, triangular, oblong or any other shape that may contribute aesthetically or functionally to the overall usefulness of the device.

For example, the device 10 may be optimally triangular if the device 10 is used to apply a coating to the inside of a corner on a surface that the device 10 is applying fluid upon to allow for more complete coverage of the fluid being dispensed.

In one embodiment of the present invention is disclosed a disposable fluid applicator comprising a tab assembly 12, an applicator assembly 20 and a reservoir assembly 30. Said reservoir assembly 30 having a reservoir formed by a first membrane 32 and a second membrane 34 sealed together around the periphery of said first membrane 32 and said second membrane 34. Said first membrane 32 having a plurality of perforations 36. Said second membrane 34 being impermeable. Said applicator assembly 20 being porous and/or absorbent and being affixed to said first membrane 32. Said applicator assembly 20 covering said perforations. Said tab assembly 12 being disposed between said first membrane 32 and said applicator assembly 20. Said tab assembly 12 sealing said perforations 36 in said first membrane 32. Said tab assembly 12 being removable from between said first membrane 32 and said applicator assembly 20 thereby unsealing said perforations 36.

In another variation of the invention the disposable fluid applicator 10 is further characterized in that a seal 40 is affixed to said first membrane 32 that is adhearable to said applicator assembly 20 when said tab assembly 12 is removed that substantially completes a seal between the periphery of said first membrane 32 and the periphery of said applicator assembly 20.

In another variation of the invention the disposable fluid applicator is further characterized in that said applicator assembly 20 is formed of any one of a non-woven fibrous material, a fabric material, a sponge material or a porous synthetic material.

In another example, a more oval shape may be more aesthetically pleasing. Other shapes or various configurations may be suited to any of a variety of applications where a particular form may have advantages over the basic circular or oval shape shown in the drawings.

Now referring to the variation of the device as demonstrated in FIGS. 6 through 9 where this variation of the device is shown to include, inter alia, an applicator 60, a tab 62, a layer 64, scores 66, a layer 68, a pocket 70, welds 72, a finger 74 (not included in the claimed invention but shown in broken lines for illustrative purposes only), a chamber 76, a aperture 78 and a tab 80.

Generally, the device is constructed of four layers: the applicator 60, the layer 64, the layer 68 and the pocket 70 all affixed together at the welds 72. The welds 72 encircle the periphery of the device and provide a hermetically sealed seam. The inner two plies, the layer 64 and layer 68 are impermeable layers that form the boundaries of the chamber 76. The chamber 76 contains a fluid that the device is designed to dispense.

The pocket 70 layer may be, but is not necessarily, impermeable. An aperture 78 is present on the pocket 70 layer on the edge of the welds 72 and is dimensioned to receive a human finger 74 to hold the device and aid in dispensing the fluid contained in the chamber 76.

Generally, a fluid is contained inside the chamber 76 formed between impermeable layers 64 and 68 and sealed around the edges at welds 72. Layers 64 and 68 may be constructed of any of a variety of known flexible and impermeable thin layer materials such as, for example, foil, plastic, other synthetic, polymer, metal or alloy. Although the welds 72 are described as being 'welded' it should be appreciated that layers 64 and 68 could also be hermetically joined by adhesive or other available and known bonding and sealing means.

Figure 6:
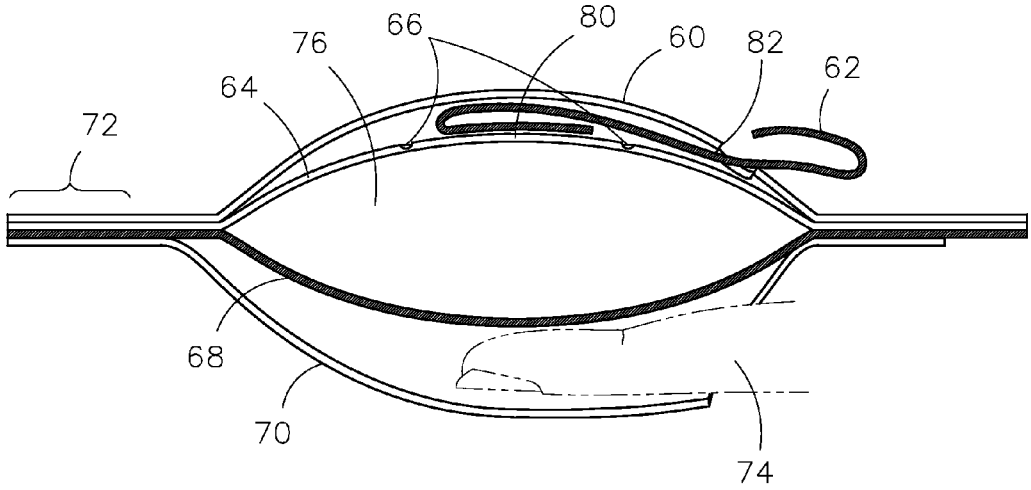
FIG. 6 shows a cross section of a variation of the device with a human finger that is not an element of the invention.
Figure 7:
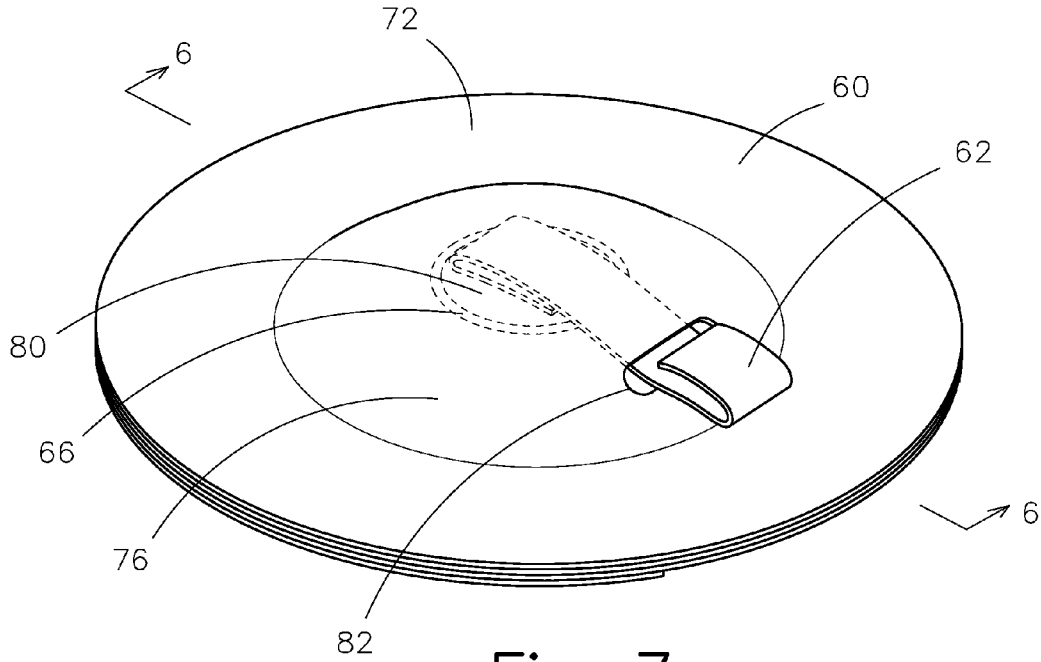
FIG. 7 is a perspective view of a variation of the device similar to that shown in FIG. 6.
Figure 8:
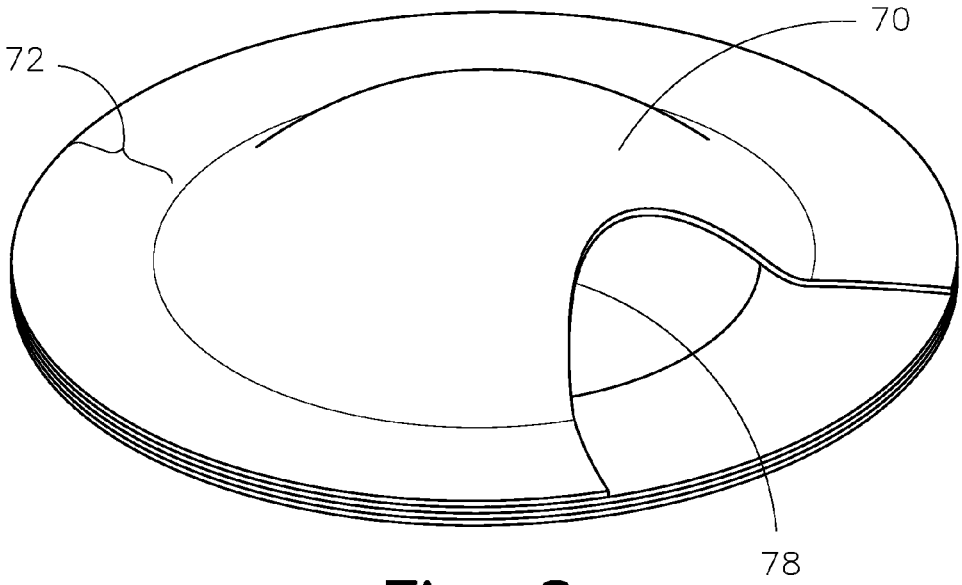
FIG. 8 shows a perspective view of the device showing the opposite side as that shown in FIG. 7.
Figure 9:
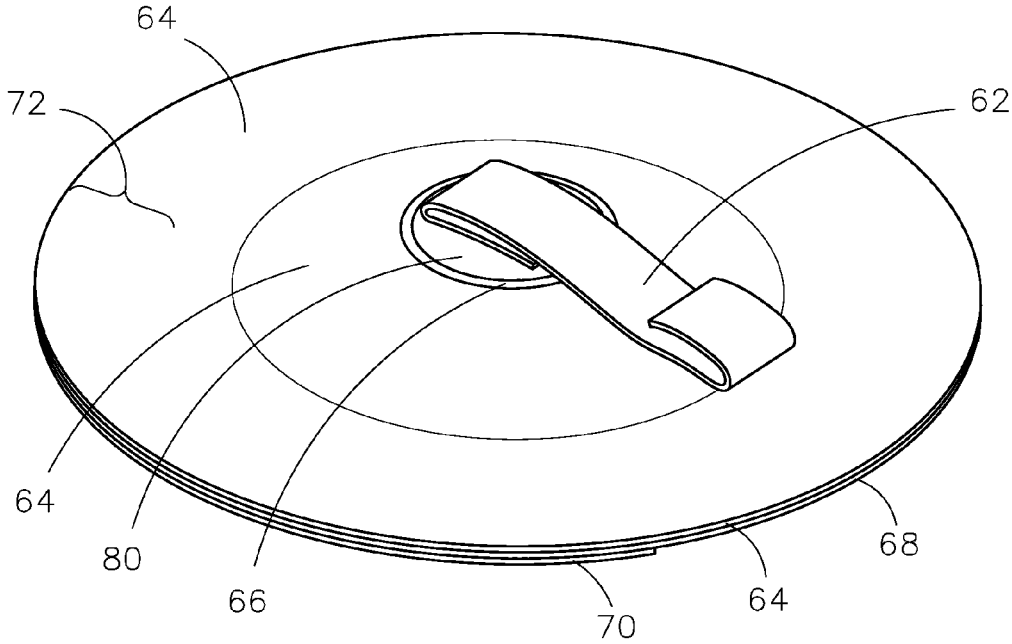
FIG. 9 demonstrates a perspective view from a similar angle of the device as shown in FIG. 7 with the top applicator layer removed to show the tab and scores in more detail.

A key feature of this variation of the device shown in FIGS. 6 though 9 are the scores 66 that form a ring of predetermined dimensions on the surface of layer 64. The periphery of the scores 66 is the boundary for the tab 80 that is a sub-part of the layer 66. The tab 62 is affixed at one end to the tab 80 on the layer 66. At the opposite end the tab 62 passes through an aperture 82 in the applicator 60 layer. For manufacturing purposes the tab 62 may optionally be folded back onto itself so that it does not interfere with the formation of the welds 72 that seal and connect the several layers of the device.

The scores 66 are essentially indentations or etches on the surface of layer 64 to strategically weaken the layer 64 along the score 66 lines so that when tab 62 is pulled the layer 64 is fractured along the score 66 lines. When the layer 64 is fractured along the score 66 lines the tab 80 connected to the tab 62 and both can be separated from the device through aperture 82. When tab 80 is broken away from layer 64 the fluid contained in the chamber 76 can flow out of the chamber 76 and disperse into the applicator 60 layer where it can be applied to an external surface. For example, if the fluid is a skin cream then the fluid escaping from the chamber 76 into the applicator 60 can be spread onto the skin.

For improved ease and accuracy of dispensation of the fluid in the device a pocket 70 layer is provided bounded on the other side by layer 68. An aperture 78 is provided to allow access by a human finger 74. Once the tab 80 is removed the fluid inside the chamber 76 may be pressured by the finger 74 when the applicator 60 is in contact with the surface (i.e. skin) that the fluid is to be applied upon. This essentially squeezes the fluid in the chamber 76 through the applicator 60 and out of the device onto, for example, the skin of the user.

For some applications of the device the several described components are preferably constructed of a biodegradable or photo-degradable material so that the entire product is more earth friendly yet retains its suitable functionality for sufficient lengths of time so as to retain the products usefulness. Yet in other applications it may be desirable to prevent any degradation of the component elements of the device. For example, this may be beneficial for unstable compounds contained within the device or for long term storage such as military first aid kits that may be in place for terms of years.

The size of the tab 80 can be varied depending on the fluid contained the chamber 76. For example, a low-viscosity fluid or one applied in minute amounts might have a smaller tab 80 so that the fluid is dispensed more slowly or controlled better. Conversely, a highly viscous fluid or one where a higher amount is applied may have a larger tab 80 so that more fluid is delivered faster from the chamber 76 and into the applicator 60 for dispensation onto a surface, such as the skin.

Applicator 60 is preferably made from a permeable material as the fluid in the chamber 76 must pass through the applicator 60 layer to be dispensed. A non-woven synthetic fabric with hypoallergenic characteristics is effective. Other fibrous, woven or knitted materials are also effective. For some applications, the applicator 60 is made of a non-permeable or low-permeable material and has a multiplicity of perforations to allow the fluid in the chamber 76 to escape when the tab 62 is pulled removing the tab 80 thereby allowing the contents of the chamber 76 to flow out and through the applicator 60 where the fluid can be applied to the appropriate surface.

Another variation of the device can be described as a disposable fluid applicator having a reservoir with a first membrane and a second membrane. Said reservoir containing a fluid to be dispensed. Said first membrane of the reservoir having perforations and being covered by a permeable and/or absorbent spreader. A removable tab assembly is disposed between said spreader and said first membrane of the reservoir that seals said reservoir. When the tab is pulled from between said spreader and said first membrane of the reservoir the reservoir becomes unsealed allowing the fluid contained inside the reservoir to flow out through an opening in the first membrane into and through the spreader where the fluid can be applied to a desired surface.

An alternate effective variation can be described as a disposable fluid applicator comprising a tab assembly, an applicator assembly and a reservoir assembly. Said tab assembly is comprised of a pull-tab and a fungible tab. Said reservoir assembly has a reservoir formed by a first membrane and a second membrane sealed together around the periphery of said first membrane and said second membrane at a predetermined margin creating a reservoir that can contain a pre-selected fluid. The first membrane having on a first surface a frangible tab bounded by scores that selectively weaken the first membrane along the scores but the scores do not penetrate the first membrane. Importantly, the second membrane is impermeable. The applicator assembly should be porous so that fluid can be dispensed through it and it is affixed to said first membrane. The applicator assembly covers said frangible tab. A pull-tab being partially disposed between said first membrane and said applicator assembly and affixed at a first end to said fungible tab and at a second end said pull-tab protrudes through an aperture in said applicator assembly. To use the device the second end of said pull-tab is pulled exceeding a predetermined force and the first membrane is fractured along said scores thereby permitting said pre-selected fluid to escape said reservoir assembly and into said spreader assembly. Optionally it can include a pocket dimensioned to fit the tip of a human finger that is affixed to said second membrane. Optionally the applicator assembly is formed of any one of a non-woven fibrous material, a fabric or knit material, a sponge material or a perforated synthetic material.

Yet another important variation can be described as disposable fluid applicator comprising a first layer, a second layer, a third layer and a fourth layer. Said first layer being permeable, said second layer being impermeable and said third layer being impermeable. Each of said layers has a predetermined similarly dimensioned perimeter. Each of said layers has a predetermined similarly dimensioned margin about the periphery and terminating in the perimeter of the respective layer. Said layers are stacked with the first layer adjacent to the second layer, the second layer between the first and third layers, the third layer between the second and fourth later and the fourth layer adjacent to the third layer, each with the respective perimeter aligned with the perimeter of the adjacent layer. Said first layer is affixed to said second layer at said margin. Said second layer is affixed to said third layer at said margin forming a hermetically sealed chamber with a predetermined volume between the second layer and the third layer. Said third layer is affixed to said fourth layer at said margin. Said hermetically sealed chamber capable of containing a pre-selected fluid. Said second layer having a score line on a first surface and said score line not in contact with the margin of the second layer. Said score line defines the boundary of a frangible tab. Said score lines weaken the second layer yet maintain the integrity of said hermetically sealed chamber. A pull tab is affixed on a first end to said frangible tab and on a second end protrudes through an aperture in said first layer. Said fourth layer has an aperture dimensioned to accept the tip of a human finger between said third and fourth layers. Optionally, said hermetically sealed chamber contains a fluid and when said pull tab is pulled with a predetermined force said second layer is breached at said score line and said pre-selected fluid can escape the hermetically sealed chamber and into said permeable first layer. Optionally, in any variation said first layer is constructed of any individual or combination selected from the group of: woven fabric, non-woven fabric, knitted fabric, perforated synthetic film, perforated metal or alloy foil. Optionally The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A disposable fluid applicator comprising a tab assembly, an applicator assembly and a reservoir assembly;

said tab assembly comprised of a pull-tab and a fungible tab;

said reservoir assembly having a reservoir formed by a first membrane and a second membrane sealed together around the periphery of said first membrane and said second membrane at a predetermined margin;

said reservoir containing a pre-selected fluid;

said first membrane having on a first surface a frangible tab bounded by scores that selectively weaken the first membrane along the scores but the scores do not penetrate the first membrane;

said second membrane being impermeable;

said applicator assembly being porous and being affixed to said first membrane;

said applicator assembly covering said frangible tab;

a pull-tab being partially disposed between said first membrane and said applicator assembly and affixed at a first end to said fungible tab and at a second end said pull-tab protrudes through an aperture in said applicator assembly;

wherein, when the second end of said pull-tab is pulled exceeding a predetermined force and the first membrane is fractured along said scores thereby permitting said pre-selected fluid to escape said reservoir assembly and into said spreader assembly.

2. A disposable fluid applicator as described in claim 1 further characterized in that a pocket dimensioned to fit the tip of a human finger is affixed to said second membrane.

3. A disposable fluid applicator as described in claim 1 further characterized in that said applicator assembly is formed of any one of a non-woven fibrous material, a fabric or knit material, a sponge material or a perforated synthetic material.

4. A disposable fluid applicator comprising a first layer, a second layer, a third layer and a fourth layer;

said first layer being permeable, said second layer being impermeable and said third layer being impermeable;

each of said layers has a predetermined similarly dimensioned perimeter;

each of said layers has a predetermined similarly dimensioned margin about the periphery and terminating in the perimeter of the respective layer;

said layers are stacked with the first layer adjacent to the second layer, the second layer between the first and third layers, the third layer between the second and fourth later and the fourth layer adjacent to the third layer, each with the respective perimeter aligned with the perimeter of the adjacent layer;

said first layer is affixed to said second layer at said margin;

said second layer is affixed to said third layer at said margin forming a hermetically sealed chamber with a predetermined volume between the second layer and the third layer;

said third layer is affixed to said fourth layer at said margin;

said hermetically sealed chamber capable of containing a pre-selected fluid;

said second layer having a score line on a first surface and said score line not in contact with the margin of the second layer;

said score line defines the boundary of a frangible tab;

said score lines weaken the second layer yet maintain the integrity of said hermetically sealed chamber;

a pull tab is affixed on a first end to said frangible tab and on a second end protrudes through an aperture in said first layer;

said fourth layer has an aperture dimensioned to accept the tip of a human finger between said third and fourth layers.

5. A disposable fluid applicator as disclosed in claim 4 that is further characterized in that said hermetically sealed chamber contains a fluid;

wherein when said pull tab is pulled with a predetermined force said second layer is breached at said score line and said pre-selected fluid can escape the hermetically sealed chamber and into said permeable first layer.

6. A disposable fluid applicator as disclosed in claim 4 that is further characterized in that said first layer is constructed of any individual or combination selected from the group of: woven fabric, non-woven fabric, knitted fabric, perforated synthetic film, perforated metal or alloy foil.

7. A disposable fluid applicator as disclosed in claim 5 that is further characterized in that said first layer is constructed of any individual or combination selected from the group of: woven fabric, non-woven fabric, knitted fabric, perforated synthetic film, perforated metal or alloy foil.

* * * * *